US011787615B2

(12) United States Patent
Repp et al.

(10) Patent No.: US 11,787,615 B2
(45) Date of Patent: Oct. 17, 2023

(54) BAG AND FILM TUBE FOR PRODUCING SUCH A BAG

(71) Applicant: Bischof + Klein SE & Co. KG, Lengerich (DE)

(72) Inventors: Waldemar Repp, Hagen (DE); Reinhard Bergmann, Wallenhorst (DE); Frank Heermann, Lotte (DE); Carsten Michel, Hagen (DE); Christoph Reinker, Lengerich (DE); Uwe Wiegand, Hörstel (DE); Rolf zum Dohme, Lengerich (DE); Jürgen Sundermann, Lengerich (DE)

(73) Assignee: Bischof + Klein SE & Co. KG, Lengerich (DE)

( * ) Notice: Subject to any disclaimer, the term of this patent is extended or adjusted under 35 U.S.C. 154(b) by 0 days.

(21) Appl. No.: 17/298,034

(22) PCT Filed: Dec. 3, 2019

(86) PCT No.: PCT/EP2019/083529

§ 371 (c)(1),
(2) Date: May 28, 2021

(87) PCT Pub. No.: WO2020/115062

PCT Pub. Date: Jun. 11, 2020

(65) Prior Publication Data

US 2022/0097943 A1 Mar. 31, 2022

(30) Foreign Application Priority Data

Dec. 3, 2018 (DE) ..... 20 2018 106 868.7

(51) Int. Cl.

| | |
|---|---|
| ***B65D 75/62*** | (2006.01) |
| ***B65D 75/58*** | (2006.01) |
| ***B65D 75/12*** | (2006.01) |

(52) U.S. Cl.
CPC ..... *B65D 75/5844* (2013.01); *B65D 75/12* (2013.01)

(58) Field of Classification Search
CPC ..... B65D 75/12; B65D 75/66; B65D 75/68; B65D 75/58; B65D 75/5805;
(Continued)

(56) References Cited

U.S. PATENT DOCUMENTS

| | | | | |
|---|---|---|---|---|
| 5,184,771 A * | 2/1993 | Jud | B65D 75/5844 229/87.05 |
| 5,582,342 A * | 12/1996 | Jud | B65D 75/5838 229/87.05 |
| 2016/0176601 A1* | 6/2016 | Boekeloo | B65D 75/5838 206/457 |

FOREIGN PATENT DOCUMENTS

| | | |
|---|---|---|
| DE | 38 36 227 | 4/1990 |
| DE | 20 2016 102 623 | 8/2016 |

(Continued)

*Primary Examiner* — Jes F Pascua
*Assistant Examiner* — Nina K Attel
(74) *Attorney, Agent, or Firm* — Gudrun E. Huckett

(57) ABSTRACT

The invention relates to a bag (3) having a filling space for bulk material, which filling space is delimited by a lower base (4), a circumferential wall (6), and an upper filling space closure (8) facing away from the lower base (4). The bag has at least one tear-open strip (10) for exposing an opening area (12) of the bag (2), which is delimited by an upper weakening line (14) and a lower weakening line (16), wherein both weakening lines (14, 16) extent parallel to the upper filling space closure (8), and the upper weakening line (14) is positioned between the upper filling space closure (8) and the lower weakening line (16). The bag (2) has a longitudinal seam (18) extending transversely with respect to the upper filling space closure (8). The upper and the lower weakening line (14, 16) begin in the area of the longitudinal seam (18). The longitudinal seam (18) is
(Continued)

formed so as to be weaker in the area between the two weakening lines (14, 16) than above the upper weakening line (14) and below the lower weakening line (16).

9 Claims, 4 Drawing Sheets

(58) Field of Classification Search
CPC ..... B65D 75/5811; B65D 75/5827; B65D 75/5833; B65D 75/5838; B65D 75/5844; B65D 75/5866; B65D 75/56; B65D 75/563
USPC ..... 383/205, 207, 200, 66, 7; 229/87.05
See application file for complete search history.

(56) References Cited

FOREIGN PATENT DOCUMENTS

| | | |
|---|---|---|
| EP | 0 620 157 | 10/1994 |
| EP | 0 779 222 | 6/1997 |
| FR | 2 951 439 | 4/2011 |
| WO | 2011/121337 | 10/2011 |

* cited by examiner

BAG AND FILM TUBE FOR PRODUCING SUCH A BAG

BACKGROUND OF THE INVENTION

The invention concerns a bag with a filling space for bulk material that is delimited by a lower bottom, a circumferentially extending wall, and an upper filling space closure which is facing away from the lower bottom. The bag comprises a tear-open strip for opening an opening field of the bag that is delimited by an upper weakening line and a lower weakening line, wherein both weakening lines extend parallel to the upper filling space closure and the upper weakening line is positioned between the upper filling space closure and the lower weakening line.

Such a bag is disclosed, for example, in EP 0 620 157 B1. By means of the tear-open strip, the entire region of the bag above the strip is separated from the lower portion of the bag which accommodates the filling material. The weakening lines and also an end face line, which extends perpendicularly to the two weakening lines and where the tear-open strip begins, are perforated, respectively. For opening the tear-open strip, the end face line perforation is pushed in by a finger of the person opening the bag and, subsequently, the tear-open strip in this region is gripped from the inner side of the bag material and from the outer side of the bag material by thumb and index finger and torn open farther along the weakening lines. Handling of the opening action is however not clean because the operator comes into contact with the contents of the bag during tearing and, moreover, pushing in the perforation along the end face line cannot always be realized without error.

The invention has the object to provide a bag of the aforementioned kind with improved opening possibility.

SUMMARY OF THE INVENTION

The invention is solved by a bag of the aforementioned kind in which the bag comprises a longitudinal seam extending transversely to the upper filling space closure, wherein the upper and the lower weakening lines begin in the region of the longitudinal seam and the longitudinal seam in the region between the two weakening lines is embodied weaker than above the upper weakening line and below the lower weakening line. The tear-open strip therefore adheres more weakly to the bag material located in the region of the longitudinal seam underneath the tear-open strip and, fixed between thumb and index finger of an operator, can be easily removed initially from the bag material located underneath the tear-open strip in the region of the longitudinal seam and subsequently torn open along the weakening lines. In this context, the fingers of the operator do not contact the filling material contained in the bag.

Advantageously, the bag comprises in the region of the longitudinal seam between the two weakening lines a disrupting compound which impairs the welding process. The latter is formed particularly preferred by a lacquer that is applied in the region of the longitudinal seam between the weakening lines in the form of a grid at the side of the tear-open strip which is facing the filling space or at the side of the bag material facing away from the filling space underneath the tear-open strip. The lacquer is preferably selected in this context such that an adherence of an additional melt for forming the longitudinal seam is embodied significantly more weakly in relation to the lacquer than to the remaining bag material in the region of the longitudinal seam.

In a particularly preferred embodiment of the invention, a tab is arranged at the start of the tear-open strip between the two weakening lines and projects opposite to the tear-open direction past the longitudinal seam and does not adhere to the material of the wall of the bag. By means of the tab, an operator can particularly easily grip the start of the tear-open strip and open the tear-open strip in the tearing open direction along the weakening lines. When the bag is formed of a film web that is folded over to a film hose wherein the two sides of the film web are placed on top of each other and are connected by means of the longitudinal seam, the tab is formed particularly preferred in that the upper film projects slightly past the longitudinal seam past the lower film web in circumferential direction. In this way, along the longitudinal seam a film strip is formed that is not connected to the film positioned underneath. The two weakening lines then also extend past the longitudinal seam to the lateral end of the upper film of the bag. The weakening lines do not extend however to the lower film in the region of the longitudinal seam. The position indication of the start of the weakening lines in the region of the longitudinal seam is to be understood in the meaning of this invention such that the weakening lines either begin where the longitudinal seam extends or, in case of formation of the aforementioned tab, projects slightly past the longitudinal seam opposite to the tearing open direction.

In a preferred embodiment of the invention, the bag material in the region of the ends of the weakening lines and the material and the width of the tear-open strip are configured such that the resistance against tearing open of the tear-open strip past the ends of the weakening lines is greater than the resistance against tearing off the strip from the bag. The bag can therefore be opened upon opening of the opening field along the weakening lines only to the end of the weakening lines and not past it because, upon further pulling action on the tear-open strip, the bag will not open further but the tear-open strip will be torn off. The ends of the weakening lines are understood as the respective side of the weakening lines toward which the tear-open strip is opened, opening the opening field, when tearing open along the weakening lines.

In a particularly preferred embodiment of the invention, the bag is comprised of a film that is of a single layer or multilayer configuration.

In a preferred embodiment of the invention, the bag is a side gusset bag with a front side and a rear side that are connected to each other by a first sidewall and a second sidewall, wherein the sidewalls each are formed by side gussets. The weakening lines extend in this context transversely across at least 80% of the width of the front side or the width of the rear side of the bag, in particular across the entire width of the front side or the entire width of the rear side. The region of the side gussets remains however free of the weakening lines, respectively. Due to this embodiment, the desired V-shaped spout below the opening field is formed particularly advantageously in the side gusset bag as a result of the positioning of the lower weakening line.

Pouring out the bulk material contained in the bag as well its metering is difficult in case of the bag disclosed in EP 0 620 157 B1 because the person pouring from the bag grips with the hand of the first arm from below the bottom of the bag and places the upper part of the remaining bag across the forearm of the second arm and subsequently must tilt the bag by means of the hand of the first arm. In order to facilitate pouring, the upper filling space closure therefore comprises a fingertip contact region on its inner side facing the filling space in a particularly preferred embodiment of the invention. The fingertip contact region is formed by a material chamfer between a first leg and a second leg of the bag, wherein the first leg extends from the upper weakening line to the material chamfer and the second leg adjoins it beginning at the material chamfer. The material chamfer can be formed either by a one-piece film by a fold or by introducing a seam or in that two films are connected to each other by a sealing seam. The first leg and the second leg of the bag are formed by a bag material surrounding the filling space. In this context, the bag is dimensioned and the tear-open strip is positioned such that the two legs, in the state with opened opening field of a bag filled with filling material, are positioned at an angle of not more than 135° when carrying the bag by reaching into the opening field. For example, the bag is carried in this context by the hand of an operator, i.e., an operator reaches with one hand into the opening field and the first leg is resting on the hand of the operator while the bag, carried by the hand, is suspended therefrom. The dimensions of the bag are selected thus in such a way that an angle of not more than 135° in the aforementioned state of the bag is formed. It has been found that by this configuration a safe carrying of the bag by reaching into the opened opening field is possible.

Advantageously, the distance of the upper weakening line in relation to the material chamfer amounts to 30 to 65 mm, particularly preferred 45 to 55 mm, and the distance of the lower weakening line in relation to the upper weakening line amounts to 15 to 25 mm. The circumferential wall of the bag comprises in this context a front side and a rear side wherein both weakening lines are arranged centered either at the front side or at the rear side of the bag and extend across 15 to 35% of the bag circumference.

The bag is opened along the weakening lines wherein the position of the weakening lines predetermines the position of the opening field in the bag. The opening field has in this context in the opened state the shape of a rectangle with a height corresponding to the distance of the weakening lines relative to each other and a length corresponding to the length of the two weakening lines. The opening field is located centered either at the front side or at the rear side of the bag and extends across 15 to 35% of the circumference of the bag.

It has been found that, for such a positioning of the opening field by means of the aforementioned positioning of the two weakening lines, the bag material between the upper material chamfer and the upper weakening line and thus the upper edge of the opening field together with the material of the upper material chamfer can be used for the hand of the further arm of the person pouring from the bag. The grip which is resulting therefrom is voluminous and at the same time strong enough in order to enable easy pouring from the bag. When the upper weakening line and thus the upper edge of the opening field is displaced farther in the direction toward the bag bottom, the fingers of the operator no longer additionally grip the upper material chamfer so that the grip loses significantly in regard to stability and the person pouring from the bag loses control over the bag. When the opening field on the other hand is moved farther in the direction toward the upper material chamfer in that the distance between the upper weakening line and the material chamfer is shortened beyond the inventive dimension, the grip becomes very narrow and uncomfortable. Especially in case of higher weight of the bag, an operator in this case would have to carry the weight primarily by the fingertips and no longer by the entire hand.

By centering the opening field at the front side or at the rear side of the bag, the weight of the bag can be balanced more easily when pouring. Due to the distance of the two weakening lines relative to each other of 15 to 25 mm and thus due to the targeted height of the opening field in connection with the extension of the weakening lines and thus also of the opening field across 15 to 35% of the circumference of the bag, a V-shaped spout along the lower edge of the opening field is produced which results from the lower weakening line with which a targeted metering and pouring direction is possible.

A person pouring from the bag grips the bag by the hand of the first arm below the bottom of the bag. With the hand of the second arm, the person reaches into the opening field and grips with the hand the bag material between the upper edge of the opening field and the material chamfer as well as additionally the material chamfer itself like a stable grip. As soon as the person holds the bag at a slant by lifting the bottom or by lowering the opening field, the lower edge of the opening field forms a V-shaped outwardly extending spout by means of which the bulk material can be discharged very easily and in a well metered way.

The upper previous filling space closure is formed in a particularly preferred embodiment of the invention by a transverse seam, wherein the transverse seam in the interior of the bag also forms the material chamfer. This configuration is provided in particular when the bag is a side gusset bag.

In an alternative embodiment thereto, the upper filling space closure is formed by an upper bottom and the material chamfer is formed by the transition of the circumferential wall of the bag into the upper bottom. The material chamfer can be in this context either a fold introduced into a film or the material of the bag is additionally sealed in this region. This embodiment is in particular present when the bag is a valve bag.

The invention is solved moreover by a film hose for producing bags of the aforementioned kind. The film hose comprises in this context a plurality of tear-open strips arranged parallel to each other at identical distances for opening a respective opening field. The tear-open strips are delimited by an upper weakening line and a lower weakening line, respectively. The film hose is formed by a film web that is folded to a hose, wherein the film hose comprises a longitudinal seam extending lengthwise in relation to the film hose that connects the two lateral ends of the film web placed on top of each other, whereby the film hose is formed. Correspondingly, the wall of the aforementioned bags is also formed circumferentially, of course. Due to this configuration of the film hose, a bag according to the invention of the aforementioned kind can be formed from the film hose with the advantages mentioned in connection with the bags according to the invention.

In a particularly preferred embodiment of the invention, at the start of each tear-open strip of the film hose a tab is arranged between the two weakening lines correlated with this tear-open strip which projects opposite to the tearing open direction past the longitudinal seam and does not adhere to the material of the wall of the film hose. The bags according to the invention which result from this from the film hose according to the invention comprise therefore the advantages described with the aforementioned tabs in connection with the bags when opening the opening field.

In an advantageous embodiment of the film hose according to the invention, the latter comprises a plurality of material chamfer regions, arranged transversely to the longitudinal extension of the film hose, for introducing a respective material chamfer that is correlated with a tear-open strip, respectively. The distance of the respective upper weakening line to the correlated material chamfer region amounts to 30 to 65 mm, in particular 45 to 55 mm, and the distance of the respective lower weakening line to the respective upper weakening line of each tear-open strip amounts to 15 to 25 mm. In this context, the weakening lines on the film hose in its laid-flat state are arranged centered and extend across 15 to 35% of the film hose circumference. Due to this configuration of the film hose, a bag of the aforementioned kind can be produced from the film hose with the advantages that have already been disclosed above in regard to this bag.

In a preferred embodiment of the film hose according to the invention, the films of the film hose in the region of the ends of the weakening lines and the material and the width of the tear-open strip are configured such that the resistance against tearing open of the tear-open strip across the ends of the weakening lines is larger than the resistance against tearing off the tear-open strip from the film hose. Here also, with a film hose according to the invention configured in this way, a bag of the aforementioned kind can be produced with the advantages mentioned in relation to this bag.

BRIEF DESCRIPTION OF THE DRAWINGS

Further details and advantageous embodiments of the invention will be explained in the following with the aid of a schematically illustrated bag and a schematically illustrated detail of a film hose according to the invention; it is shown in.

DESCRIPTION OF PREFERRED EMBODIMENTS

In the following, elements of the invention acting in the same way are provided with a uniform reference number, provided this is expedient. In particular, elements of the bag according to the invention which can be found also in the film hose according to the invention are provided with a uniform reference number. The features of the invention explained in the following with the aid of the embodiments can be subject matter of the invention also individually or in other combinations than illustrated in the embodiment.

Figure 1:
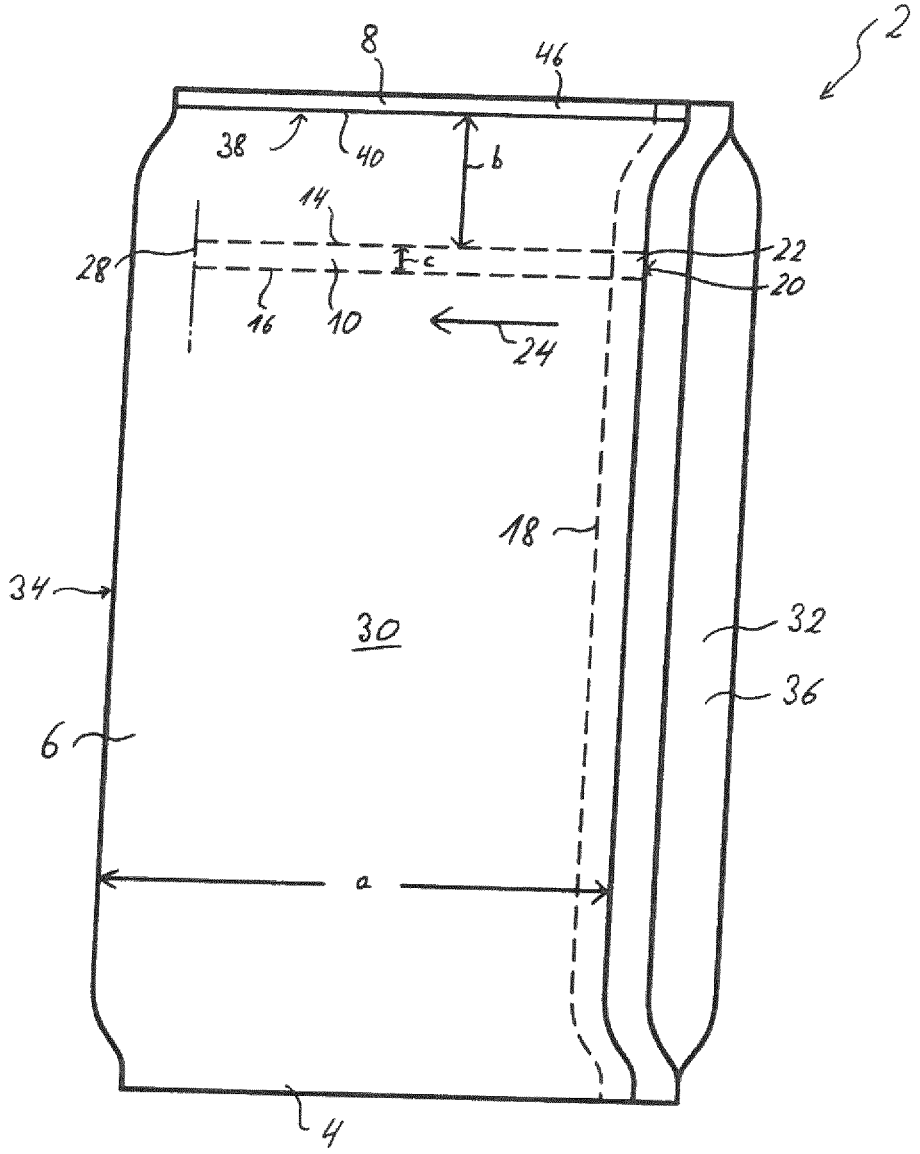
FIG. 1 a bag according to the invention with closed opening field.
Figure 2:
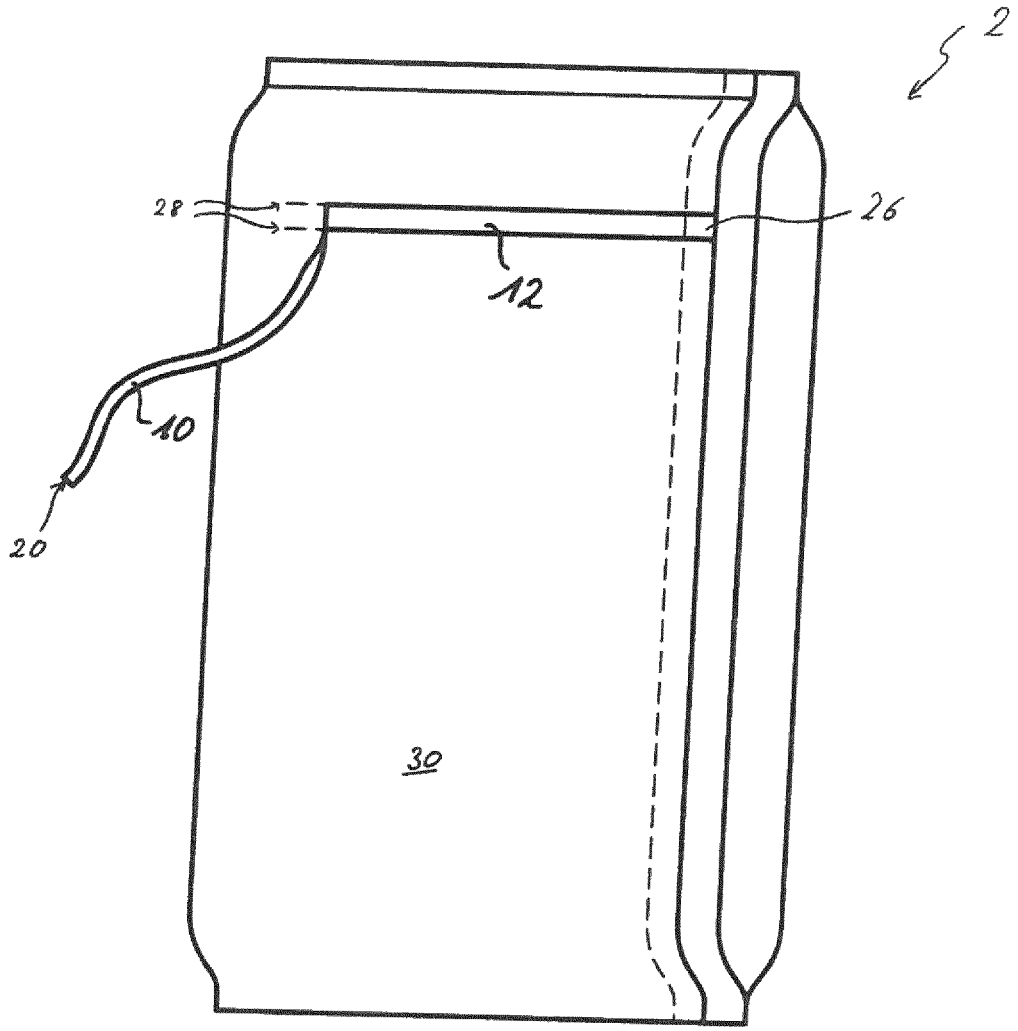
FIG. 2 a bag according to the invention corresponding to FIG. 1 with tear-open strip torn open along the weakening lines.
Figure 3:
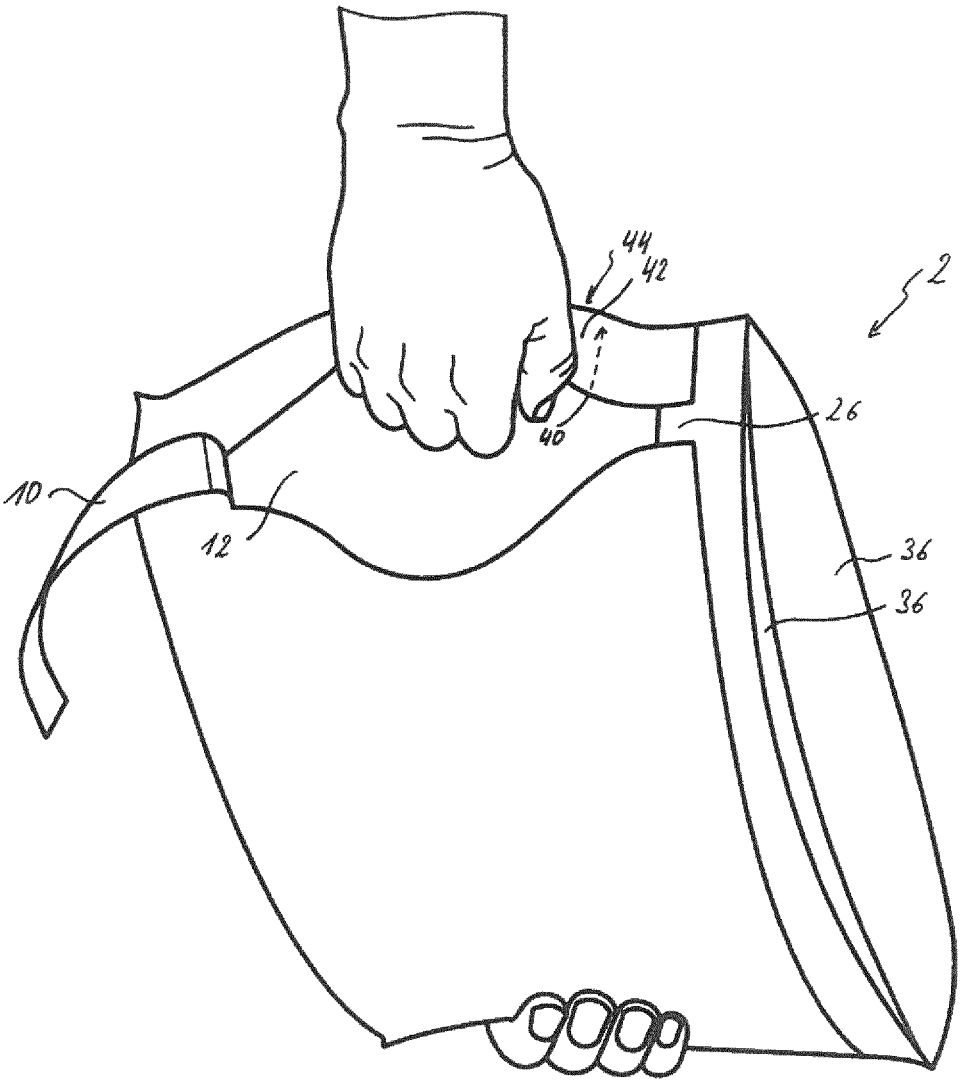
FIG. 3 an object of FIG. 2 in pouring position, showing the grip and the V-shaped spout.

FIGS. 1 to 3 show a bag 2 according to the invention with a filling space for bulk material that is delimited by a lower bottom 4, a circumferential wall 6, and an upper filling space closure 8 facing away from the lower bottom 4. The bag 2 comprises a tear-open strip 10 for opening an opening field 12 of the bag 2 that is delimited by an upper weakening line 14 and a lower weakening line 16. Both weakening lines 14, 16 extend in this context parallel to the upper filling space closure 8 and the upper weakening line 14 is positioned between the upper filling space closure 8 and the lower weakening line 16. The bag 2 comprises a longitudinal seam 18 extending transversely to the upper filling space closure 8. The upper and the lower weakening lines 14, 16 begin respectively in the region of the longitudinal seam 18. In the region between the two weakening lines 14, 16, the longitudinal seam 18 is embodied weaker than above the upper weakening line 14 and below the lower weakening line 16.

At the start 20 of the tear-open strip 10 between the two weakening lines 14, 16, a tab 22 is arranged that projects past the longitudinal seam 18 opposite to the tearing open direction, wherein the tearing open direction is illustrated in the embodiment by the arrow 24 and does not adhere to the material 26 of the wall 6 of the bag 2 in this region.

The bag material in the region of the ends 28 of the weakening line 14, 16 and the material and the width of the tear-open strip 10 are configured such that the resistance against tearing open the tear-open strip 10 past the ends 28 of the weakening lines 14, 16 is greater than the resistance against tearing off the tear-open strip 10 from the bag 2.

In the illustrated embodiment, the bag 2 is a side gusset bag with a front side 30 and an oppositely positioned rear side which cannot be seen in the embodiment. Front side 30 and rear side are connected to each other by a first side wall 32 and a second side wall whose position is indicated by arrow 34. The sidewalls 32, 34 are formed by side gussets 36, respectively, and the weakening lines 14, 16 extend transversely across at least 80% of the width a of the front side 30. The region of the side gussets 36 is free of weakening lines 14, 16 in this context.

The upper filling space closure 8 comprises a fingertip contact region 38 at its inner side facing the filling space which is formed by a material chamfer 40 between a first leg 42 and a second leg of the bag 2, which cannot be seen in the Figures whose position is however indicated by the arrow 44. The first leg 42 extends in this context from the upper weakening line 16 to the material chamfer 40 and the second leg 44 adjoins it beginning at the material chamfer 40. In the state of the bag 2 filled with filling material with opened opening field 12, the two legs 42, 44 are positioned at an angle of not more than 135° when carrying the bag 2 by reaching into the opening field 12. This holding position is illustrated in approximation in FIG. 3 wherein the bag 2 in FIG. 3 is held additionally by a second hand below the bag 2.

The distance b of the upper weakening line 14 in relation to the material chamfer 40 amounts to 30 to 65 mm and particularly preferred 45 to 55 mm. The distance c of the lower weakening line 16 in relation to the upper weakening line 14 amounts to 15 to 25 mm. The circumferential wall 6 of the bag comprises here also a front side 30 and a rear side that cannot be seen in the embodiment wherein both weakening lines 14, 16 are arranged centered at the front side of the bag 2 and extend across 15 to 35% of the bag circumference.

The upper filling space closure 8 in the embodiment is formed by a transverse seam 46 and the transverse seam 46 forms in the interior of the bag 2 also the material chamfer 40.

Figure 4:
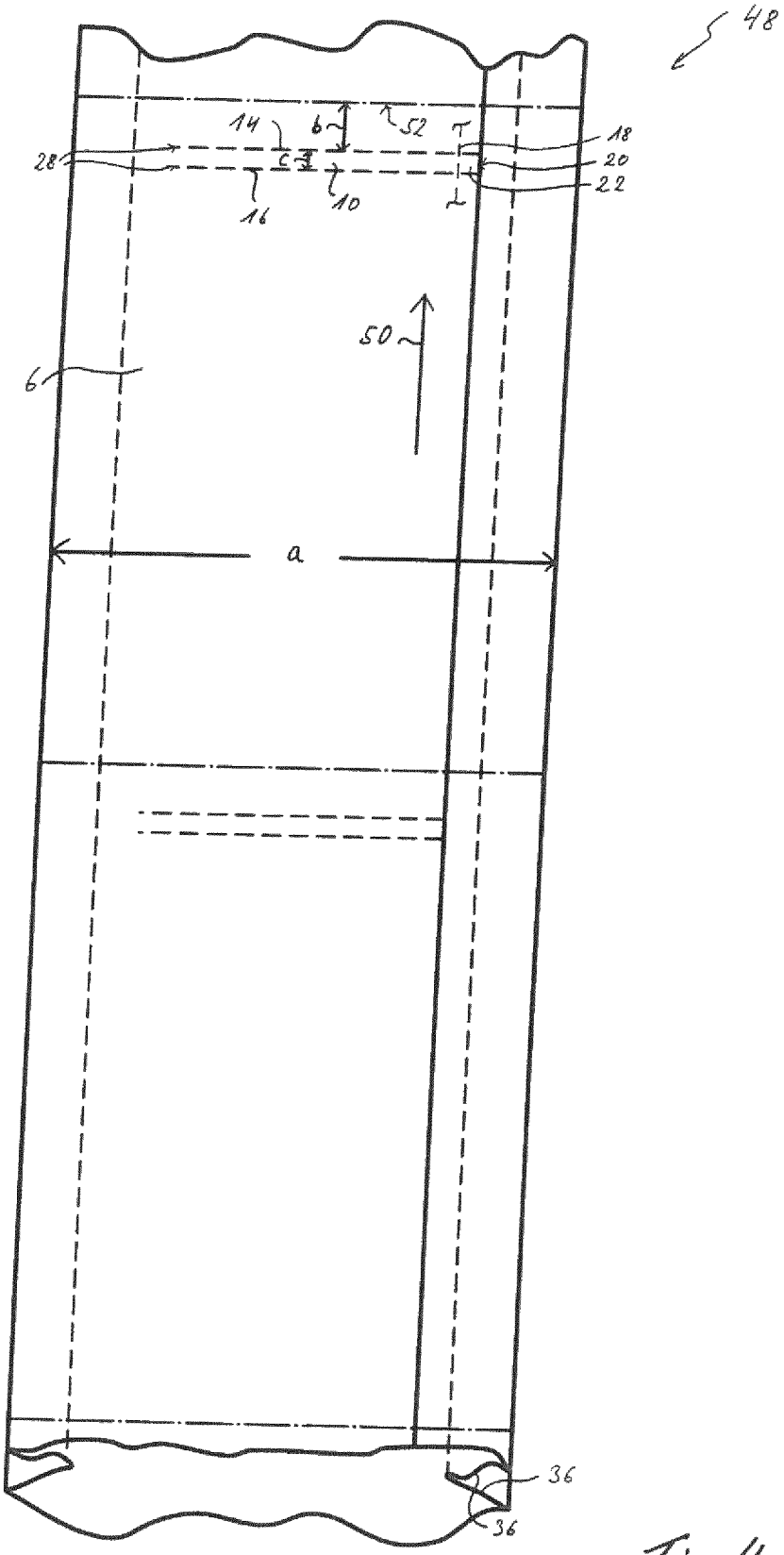
FIG. 4 a detail of the laid-flat film hose.

FIG. 4 shows a detail of a film hose 48 according to the invention for producing the aforementioned bags 2 according to the invention. The film hose 48 comprises a plurality of tear-open strips 10 arranged at identical distances parallel to each other for opening a respective opening field 12 which are delimited respectively by an upper weakening line 14 and a lower weakening line 16. The film hose 48 comprises in addition a longitudinal seam 18 extending lengthwise in relation to the film hose 48. The upper and the lower weakening lines 14, 16 begin respectively in the region of the longitudinal seam 18, and the longitudinal seam 18 in the region between the upper and lower weakening lines 14, 16 correlated with a tear-of strip 10 is embodied weaker than above the upper weakening line 14 and below the lower weakening line 16.

In the film hose 48 according to the invention, at the start 20 of each tear-open strip 10 between the two weakening lines 14, 16 correlated with this tear-open strip 10, a tab 22 is arranged which projects opposite to the tearing open direction 24 past the longitudinal seam 18 and does not adhere to the material 26 of the wall 6 of the bag 2. The film hose 48 comprises in addition a plurality of material chamfer regions 52 for introducing a material chamfer 40, respectively, which are arranged at identical distances transverse to the longitudinal extension, illustrated by the arrow 50, of the film hose 48. The distance b of the upper weakening line 14 of the correlated tear-open strip 10 in relation to the material chamfer region 52 amounts to 30 to 65 mm and in particular 45 to 55 mm. The distance c of the lower weakening line 16 to the upper weakening line 14 of each tear-open strip amounts to 15 to 25 mm. The weakening lines 14, 16 are arranged centered on the film hose 48 in its laid-flat state, illustrated in FIG. 4, and extend across 15 to 35% of the film hose circumference.

The film of the film hose 48 in the region of the ends 28 of the weakening lines 14, 16 and the film and the width of the tear-open strip 10 are configured such that the resistance against tearing open the tear-open strip 10 past the ends 28 of the weakening lines 14, 16 is greater than the resistance against tearing off the tear-open strip 10 from the film hose 48.

Reference Numbers

2 bag
4 lower bottom
6 wall
8 upper filling space closure
10 tear-open strip
12 opening field
14 upper weakening line
16 lower weakening line
18 longitudinal seam
20 start of the tear-open strip
22 tab
24 tearing open direction
26 material of the wall
28 end of the weakening lines
30 front side
32 first sidewall
34 second sidewall
36 side gussets
a width of the front side
38 fingertip contact region
40 material chamfer
42 first leg
44 second leg
b distance upper weakening line—material chamfer
c distance upper weakening line—lower weakening line
46 transverse seam
48 film hose
50 longitudinal extension
52 material chamfer region

What is claimed is:

1. A bag comprising:

a lower bottom, a circumferential wall, and an upper filling space closure facing away from the lower bottom, wherein the lower bottom, the circumferential wall, and the upper filling space closure define a filling space of the bag for bulk material;

a longitudinal seam extending transversely to the upper filling space closure;

at least one tear-open strip for opening an opening field of the bag, wherein the at least one tear-open strip is delimited by an upper weakening line and a lower weakening line, wherein the upper and the lower weakening lines extend parallel to the upper filling space closure, and wherein the upper weakening line is positioned between the upper filling space closure and the lower weakening line;

wherein the upper and the lower weakening lines begin in a region of the longitudinal seam;

wherein the longitudinal seam is weaker in a region of the longitudinal seam between the upper and the lower weakening lines than in a region above the upper weakening line and in a region below the lower weakening line;

wherein the bag is a side gusset bag and the circumferential wall comprises a front side and a rear side connected to each other by a first sidewall and a second sidewall, wherein the first and second sidewalls are formed by side gussets, respectively, and wherein the upper and the lower weakening lines extend transversely across at least 80% of a width of the front side or a width of the rear side and do not extend into the side gussets;

wherein a distance of the upper weakening line in relation to a material chamfer of the bag amounts to 30 to 65 mm, wherein a distance of the lower weakening line in relation to the upper weakening line amounts to 15 to 25 mm, and wherein the upper and the lower weakening lines are arranged centered either at the front side or at the rear side and extend across 15% to 35% of a circumference of the bag.

2. The bag according to claim 1, further comprising a disrupting compound impairing a welding process in the region of the longitudinal seam between the upper and the lower weakening lines.

3. The bag according to claim 1, further comprising a tab arranged at a start of the tear-open strip between the upper and the lower weakening lines, wherein the tab projects opposite to a tear open direction past the longitudinal seam and does not adhere to a material of the circumferential wall of the bag.

4. The bag according to claim 1, wherein a material and a width of the at least one tear-open strip and a bag material of the bag in a region of ends of the upper and the lower weakening lines are configured such that a resistance against tearing open the at least one tear-open strip past the ends of the upper and lower weakening lines in a tear open direction is greater than a resistance against tearing off the at least one tear-open strip from the bag.

5. The bag according to claim 1, wherein the bag is comprised of a film.

6. The bag according to claim 1, wherein the upper and the lower weakening lines extend across the entire width of the front side or the entire width of the rear side.

7. The bag according to claim 1, wherein the upper filling space closure comprises a fingertip contact region at an inner side thereof facing the filling space, wherein the fingertip contact region is formed by the material chamfer between a first leg and a second leg of the bag, wherein the first leg extends from the upper weakening line to the material chamfer, wherein the second leg adjoins the first leg beginning at the material chamfer, and wherein the first and the second legs, in a state of the bag filled with the filling material and with the opening field open, are positioned at an angle of not more than 135 degrees when carrying the bag by reaching into the opening field.

8. The bag according to claim 7, wherein the upper filling space closure is a transverse seam and the transverse seam forms the material chamfer in an interior of the bag.

9. The bag according to claim 7, wherein the upper filling space closure is formed by an upper bottom and wherein the material chamfer forms a transition of the circumferential wall to the upper bottom.

* * * * *